US005381651A

United States Patent [19]

Stahlecker

[11] Patent Number: 5,381,651

[45] Date of Patent: Jan. 17, 1995

[54] ARRANGEMENT FOR MONITORING THE LAP FORMATION ON DRAFTING UNITS OF A SPINNING MACHINE

[75] Inventor: Gerd Stahlecker, Eislingen/Fils, Germany

[73] Assignees: Fritz Stahlecker, Bad Ueberkingen; Hans Stahlecker, Suessen, both of Germany

[21] Appl. No.: 933,098

[22] Filed: Aug. 21, 1992

[30] Foreign Application Priority Data

Sep. 20, 1991 [DE] Germany ..... 4131418

[51] Int. Cl.[6] ..... D01H 13/04; D01H 13/26

[52] U.S. Cl. ..... 57/264; 19/239; 19/262; 57/81; 57/315

[58] Field of Search ..... 57/81, 264, 265, 315; 19/239, 262, 264, 265

[56] References Cited

U.S. PATENT DOCUMENTS

| | | | |
|---|---|---|---|
| 943,944 | 12/1909 | Leach | 19/262 |
| 1,014,042 | 1/1912 | Brady | 19/262 |
| 4,512,061 | 4/1985 | Hartmannsgruber et al. | 19/239 |
| 4,812,993 | 3/1989 | Konig et al. | 19/239 X |
| 4,864,694 | 12/1989 | Koning et al. | 19/239 X |
| 4,974,296 | 12/1990 | Vidler | 19/239 |
| 5,010,494 | 4/1991 | Lord | 19/239 X |
| 5,237,807 | 8/1993 | Iwade et al. | 57/81 X |

FOREIGN PATENT DOCUMENTS

| | | | |
|---|---|---|---|
| 2848464 | 11/1979 | Germany . | |
| 2061338 | 5/1981 | United Kingdom | 19/239 |

*Primary Examiner*—Daniel P. Stodola
*Assistant Examiner*—William Stryjewski
*Attorney, Agent, or Firm*—Evenson, McKeown, Edwards & Lenahan

[57] ABSTRACT

For the monitoring of the lap formation in the case of delivery bottom rollers of drafting units, sensing elements are provided which, when a lap is formed, as a result of the enlarged diameter at the delivery bottom roller, are moved radially away from this delivery bottom roller. The sensing elements are used as switching elements for an electric circuit to which a number of sensing elements, and preferably all sensing elements of the spinning machine, are assigned. When a lap is formed, the assigned electric contact is opened by the shifting movement of the sensing element so that the electric circuit is interrupted. The interruption of the electric circuit causes the triggering of a signal.

19 Claims, 3 Drawing Sheets

ARRANGEMENT FOR MONITORING THE LAP FORMATION ON DRAFTING UNITS OF A SPINNING MACHINE

BACKGROUND AND SUMMARY OF THE INVENTION

This invention relates to an arrangement for monitoring the lap formation on drafting units of a spinning machine, comprising sensing elements which are assigned to the delivery bottom rollers and move away from them in the event that fibers accumulate.

In the case of drafting units of spinning machines, laps occur from time to time at the delivery cylinder which, if they are not eliminated, result in damage to the drafting unit. Up to now, operating personnel were used for the monitoring and the eliminating of the occurring laps. These operators had to switch off the spinning machine and eliminate the laps. For preventing the lap formation, sliver stopping devices which were installed in each drafting unit were used in practical applications. These devices resulted in high technical expenditures and, like the monitoring by the operating personnel, were frequently not acceptable because of the required high expenses.

On the basis of the German Patent Document DE-OS 28 48 464, a sensing device is known for the detecting of yarn laps. The sensing element rests on the shaft of the delivery top roller. In the case of a lap formation, the contact pressure existing between the clamping rollers is eliminated. This solution also requires high technical expenditures and has not been accepted in practice.

It is an object of the invention to provide an arrangement for monitoring the lap formation which does not result in high technical expenditures and can be manufactured in a cost-effective manner.

This object is achieved according to preferred embodiments of the invention in that respective groups of sensing elements are connected to a common electric circuit which can be interrupted by the moving-away of a sensing element, and in which case the interruption triggers a signal.

The invention is based on the recognition that, when a lap is formed, the whole machine must be stopped. It is therefore not necessary to provide a signal reporting device at each drafting unit which would significantly increase the manufacturing expenditures. On the contrary, it is sufficient for a sensing element to be assigned to each drafting unit. In this case, the sensing elements of a fairly large group of drafting units together form an electric circuit which, when the operation of the spinning machine is free of disturbances, maintains a closed electric circuit. In the case of a lap formation, the electric circuit is interrupted by the moving-away of the corresponding sensing element which operates as an electric switch. The interruption of the electric circuit causes the triggering of a signal, whereby either the actuating of a disturbance report for the operating personnel is caused or a control mechanism is triggered which acts upon the spinning machine and may, for example, result in a stopping of the spinning machine.

In an advantageous development of the invention, the sensing elements of one side of the spinning machine respectively together form an electric circuit by means of which a flow of the electric current is maintained when there is no disturbance of the spinning operation.

It is also contemplated according to certain preferred embodiments to combine the sensing elements of a larger group of drafting units, for example, for one section or a plurality of sections, into an electric circuit. In the case of a corresponding signal display, it would then be easier to determine the drafting unit that requires servicing, but the technical expenditures would be correspondingly higher.

It is advantageous for all sensing elements of a spinning machine together to form an electric circuit by means of which a flow of electricity is maintained when there is no disturbance in the operation. This type of a design is particularly advantageous when, in the case of a lap formation on a drafting unit, the stoppage of the spinning machine is to be triggered directly.

In a further advantageous development, the sensing elements are equipped with conducting pieces which are connected with one another and together form the electric circuit. Contact elements are used as the connection which are detached from one another by the moving-away of a sensing element, which occurs in the case of a lap formation. The sensing elements are therefore used as switching elements, in which case the electric circuit is changed by the adjusting of the sensing elements.

In a further advantageous development, several adjacent sensing elements are arranged on a common movable bar. If a lap is formed at one drafting unit, a shifting movement of the whole bar is caused as a result of the force acting on the assigned sensing element. It will then be sufficient to provide one conducting piece along the whole length of the bar and to provide contact elements only at the respective ends of the bar, the contact elements establishing the connection to the electric line of the adjacent bar.

In the case of ring spinning machines, it is advantageous for a bar to be provided in each case for the sensing elements arranged between two roller stands.

The contact elements are advantageously arranged such that they are detached from one another when a sensing element is moved away.

The sensing elements are advantageously designed in such a manner that they are provided with contact surfaces which are situated at a distance opposite the circumference of the delivery bottom rollers and are held in this position by means of a spring force when the operation is free from disturbances. When a lap formation occurs, the diameter of the delivery bottom roller increases in such a manner that the lap comes in contact with the contact surface and moves it, together with the assigned sensing element or the assigned bar, away from the circumference of the delivery bottom roller.

Advantageously, the interruption of the electric circuit triggers an optical or acoustical disturbance report. This report will draw the attention of the operating personnel to the fact that a disturbance exists in the case of a specific spinning machine.

In another advantageous development of the invention, the interruption of the electric circuit and the signal triggered thereby initiates a control mechanism which causes the stopping of the whole spinning machine.

Other objects, advantages and novel features of the present invention will become apparent from the following detailed description of the invention when considered in conjunction with the accompanying drawings.

DETAILED DESCRIPTION OF THE DRAWINGS

Figure 1:
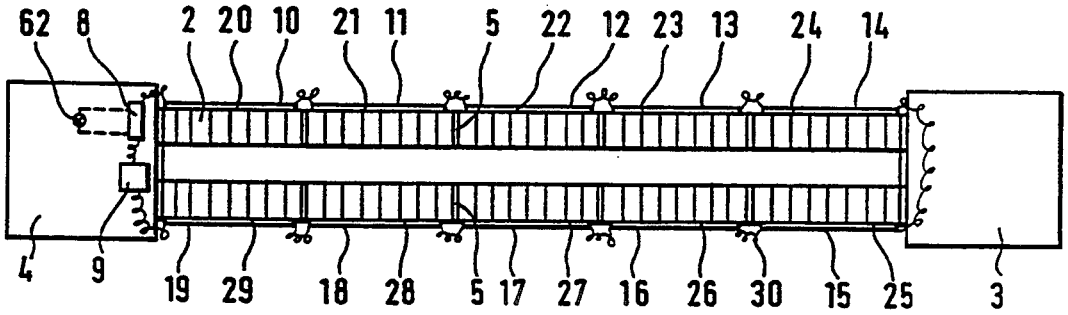
FIG. 1 is a schematic view of a spinning machine comprising a plurality of drafting units with sensing elements arranged on bars, constructed according to a preferred embodiment of the invention.

FIG. 1 illustrates a conventional ring spinning machine 1 which comprises a plurality of drafting units 2 arranged next to one another on both sides of the ring spinning machine 1. The bottom rollers of the drafting units 2 are driven by means of shafts which extend through in the longitudinal direction of the machine and are driven by motors arranged at the spinning machine head 3 or 4. The shafts, which extend through at a distance from several drafting units 2, are each disposed in roller stands 5 which are fastened to the machine frame 7 (compare FIG. 2). The roller stands 5 divide the longitudinal machine sides into so-called sections 20 to 29 which each contain a certain number of drafting units 2, for example, eight drafting units respectively.

The ring spinning machines used in practice, as a rule, comprise a larger number of drafting units and sections than illustrated in FIG. 1.

The ring spinning machine illustrated in FIG. 1 is equipped with devices for the monitoring of the lap formation in the case of delivery bottom rollers. Sensing elements are provided for each delivery bottom roller which are arranged on bars 10 to 19 (compare FIG. 1). In this case, a bar 11 to 19 is assigned to each section 10 to 29. The surfaces of the bars 11 to 19 which are situated opposite the delivery bottom rollers, as mentioned below, are designed in such a manner that they operate as sensing elements.

The bars 11 to 19 are each provided with a conducting piece which extends in the longitudinal direction for the conducting of a control current. In this case, the conducting pieces of the respective adjacent bars 10 to 19 are connected with one another by lines 30. As a result, a connected electric line is formed which extends along both longitudinal sides of the machine and is connected with a source of electricity 9 arranged at the machine head 4.

As will be described below, the current conduction arrangement composed of the conducting pieces of the bars 10 and 19 can be interrupted at the electric connecting pieces 30 between two adjacent bars or conducting pieces. If the current conduction is interrupted at any point, the flow of electricity fed by the source of electricity 9 is also interrupted. The interruption of the electric circuit has the result that a switching element 8 is switched, whereby a signal is triggered. This switching element 8 may, for example, be constructed as a relay which is equipped with a solenoid which, as long as the electric circuit is complete, is held in a certain switching position. When the electric circuit is interrupted, the power supply of the solenoid in the mentioned relay will terminate. As a result, a switch, which is present on the relay, is switched, whereby an electric control circuit is closed which is independent of the above-described electric circuit.

The electric control circuit may be designed such that, for example, a disturbance report 62 is rendered operative. The control circuit may also be designed in such a manner that the different aggregates of the ring spinning machine 1 are controlled directly and cause a stoppage of the machine.

Figure 2:
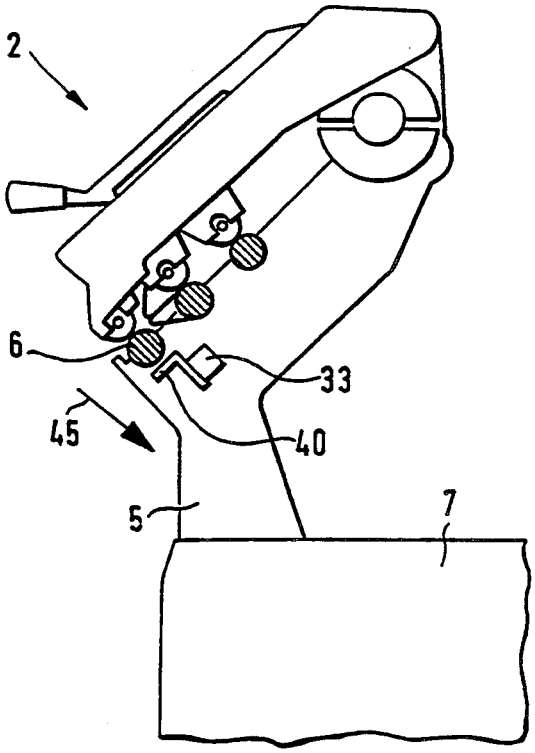
FIG. 2 is a lateral schematic view of a single drafting unit of the FIG. 1 spinning machine and which has a sensing element arranged on a bar.

FIG. 2 very schematically illustrates the construction and method of operation of a sensing element. As shown in FIG. 2, an angular bar 40 is provided as the sensing element for the drafting unit 2, this bar being held on the roller stand 5 by means of a holding element 33. The bar 40 extends from one roller stand 5 to the respective adjacent roller stand. In the case of the leg 42 bent toward the delivery bottom roller 6, the surface is created in such a manner that, as the contact surface 41 (compare FIG. 4), it is situated at a narrow distance 46 opposite the delivery bottom roller 6. The leg 42 is therefore used as the sensing element for all drafting units between two roller stands 5.

The bar 40 is held by means of a screw 35 in such a manner on the holding part 33 connected with the roller stand 5 that a shifting movement in the direction of the arrow 45 is possible, this movement being bounded by the oblong hole 43. Between the screw 35 and the leg 42, a spring 37 is clamped which holds the bar 40 which is in a position close to the delivery bottom roller 6.

Figure 3:
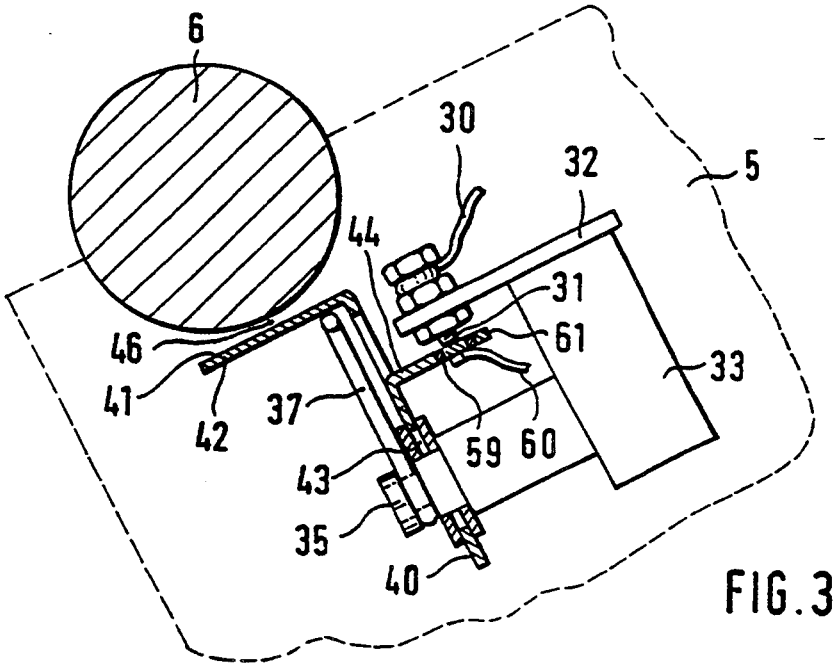
FIG. 3 is an enlarged representation of the area of the delivery bottom roller of the drafting unit illustrated in FIG. 2.
Figure 4:
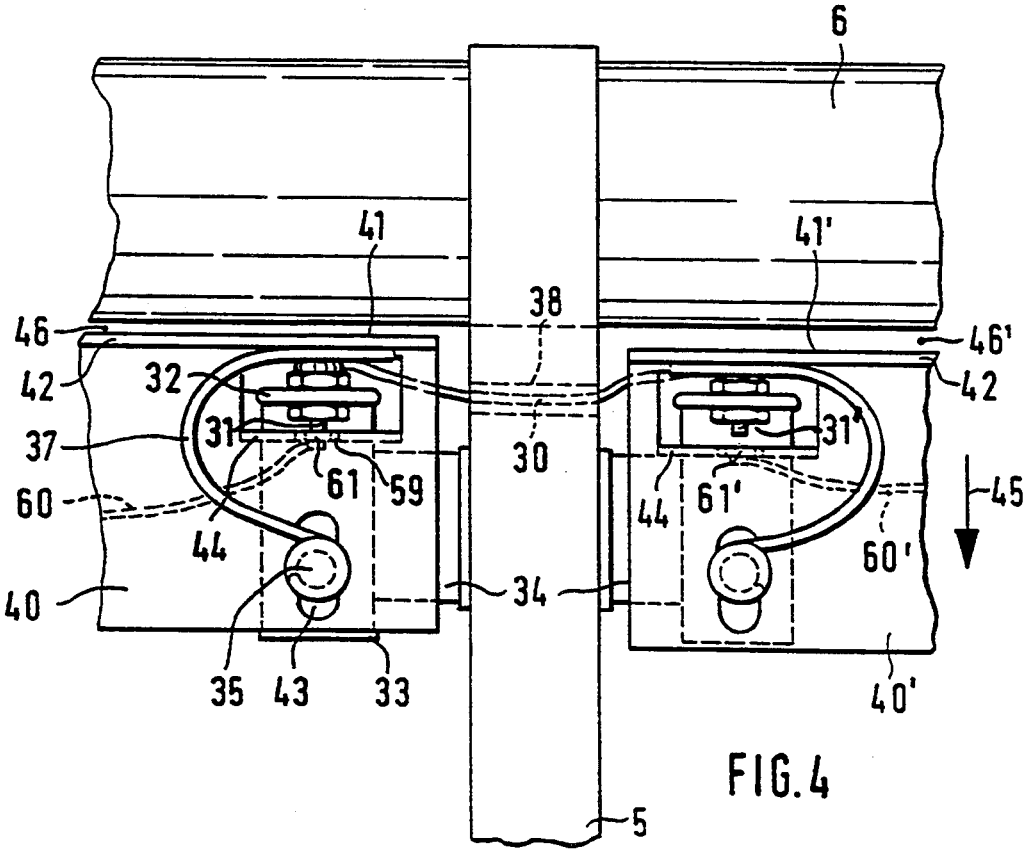
FIG. 4 is a frontal view of the area of the delivery bottom roller of FIG. 3.

On the left-hand side of FIG. 4, the bar 40, as in FIG. 3, is shown in this position close to the delivery bottom roller 6. The bar 40 is provided with a bracket 44 which projects toward the rear and rests against the front face of a screw 31. The screw 31 is used as a stop; it limits the movement of the bar 40 in the direction of the delivery bottom roller 6 and ensures that the distance 46 is maintained. The screw 31 is fastened in a stationary manner on the bracket 32 which, in turn, is connected with the holding element 33.

The bracket 44 is provided with an electric contact element 61 which is supplied, by means of the conducting piece 60, which extends in the longitudinal direction of the spinning machine, with a control current, which may, for example, have a voltage of from 12 or 24 volt. The contact element 61 is electrically insulated from the other parts of the bar 40 by means of an insulating ring 59. The bracket 32 of the holding element 33 is made of an electrically non-conductive material. The control current supplied by means of the conducting piece 60 can therefore flow, in an unimpaired manner, through the contact element 61 of the bar 40 to the screw 31, which therefore serves as a stop as well as a contact element. The contact element 31 is connected with the corresponding current-carrying elements of this bar 40' by way of an electric line 30 which is guided to the adjacent bar 40' through a bore 38 arranged in the roller stand 5. The bar 40' and the components existing there, particularly also the electronic components, are identical with the components of bar 40.

When the spinning operation is free from disturbances,—therefore, when all bars 11 to 19 are each in a position that is close to the delivery bottom roller—, the electric circuit is closed.

In the right-hand portion of FIG. 4, the bar 40' is illustrated in a position that is away from the delivery bottom roller 6. For demonstration purposes, it is assumed that a lap has formed in the case of the area of the delivery bottom roller 6 situated on the right-hand side of the roller stand 5 in FIG. 4. As a result of the lap formation, the diameter in the area of the delivery bottom roller 6 has become enlarged. The lap comes in contact with the contact surface of the bar, so that this bar is pushed away from the circumference of the delivery bottom roller in the direction of the arrow 45. The bar now takes up position 40', and the leg with the contact surface 41' takes up position 42'.

As illustrated on the right-hand side of FIG. 4, the distance 46' has increased. In addition, the contact between the contact elements 31' and 61' was eliminated. As a result, the electric circuit was interrupted. The interruption of the electric circuit leads to the triggering of the signals which were described above.

Figure 5:
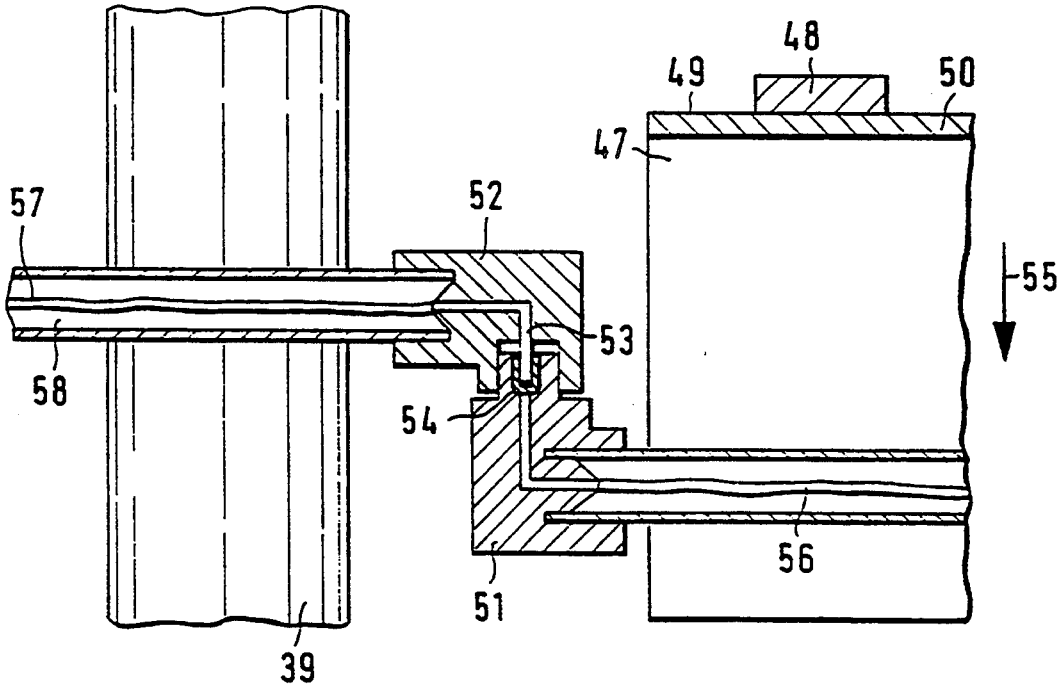
FIG. 5 is an enlarged representation of another embodiment of a sensing element mounted on a bar.

FIG. 5 illustrates another embodiment of a bar and of the pertaining electric contact elements. As indicated in FIG. 5, the electric contact elements 53, 54 and the mechanical stop 48 are arranged separately from one another. When the operation is free of disturbances, the bar 47 rests, by means of the contact surface 49 which is arranged at the leg 50, against the mechanical stop 48, in which case a defined distance is maintained to the delivery bottom roller 6 which is not illustrated in FIG. 5.

The bar 47 is provided with a conducting piece 56 which ends by means of a plug 51 in the area that is close to the roller stand 39. Inside the insulated casing of the plug 51, a bush-shaped contact element 54 is provided which is connected with the conducting piece 56.

In the area which contains the bush 54, the plug 51 is inserted into a recess of the plug 52. In this case, in the position which is illustrated in FIG. 5, the pin-shaped contact element 53 of the plug 52 projects into the bush-shaped contact element 54 of the plug 51, so that an electric connection is established which leads to the conducting piece 56. From the plug 52, an electric line 57 is guided, through a bore 58 arranged in the roller stand 39, to the adjacent bar which is not shown in FIG. 5. When there are no disturbances in the operation, a flow of current therefore exists between the individual bars and the source of electricity 9 which is arranged in the machine head.

When a lap is formed, this lap comes in contact with the contact surface 49 of the bar 47 and presses it in the direction of the arrow 55. The bush 54 will therefore no longer be in contact with the pin 53, so that the flow of current is interrupted and the above-described signals are triggered.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for monitoring the lap formation on delivery rollers of drafting units of a spinning machine, comprising:

sensing elements assigned to respective delivery rollers and being movable away from the delivery rollers when fibers accumulate on the delivery rollers, and a common electric circuit for generating a signal in response to the sensing elements, wherein groups of the sensing elements are connected to the common electric circuit, which common electric circuit is interrupted by the moving away of a sensing element to thereby trigger a signal for stopping the drive of drafting unit delivery rollers of a group of drafting units corresponding to the group of sensing elements connected to the common electric circuit.

2. An arrangement according to claim 1, wherein the sensing elements of one side of the spinning machine form a group which has a common electric circuit.

3. An arrangement according to claim 1, wherein all sensing elements of a spinning machine form a group which has a common electric circuit.

4. An arrangement according to claim 1, wherein the sensing elements are equipped with conducting pieces which extend in the longitudinal direction of the machine and which are connected with respective adjacent conducting pieces of the sensing elements of a group by means of contact elements which are detached from one another by the moving-away of a sensing element.

5. An arrangement according to claim 4, wherein several adjacent sensing elements are respectively arranged in a stationary manner on a common movable bar which is provided with a conducting piece which is connected with the conducting piece of the respective adjacent bars of a group by means of contact elements which are detached from one another by the moving-away of a sensing element.

6. An arrangement according to claim 5, wherein, in the case of a ring spinning machine, the sensing elements arranged between two roller stands are assigned to a common bar.

7. An arrangement according to claim 5, wherein the bar is moved away from the delivery bottom rollers against the force of a spring.

8. An arrangement according to claim 5, wherein the contact elements are arranged so that they are detached from one another by the moving-away of a sensing element.

9. An arrangement according to claim 8, wherein the sensing elements are provided with contact surfaces which are situated opposite the circumference of the delivery bottom rollers at a distance and are moved away from them while overcoming a spring force.

10. An arrangement according to claim 9, wherein the bar is moved away from the delivery bottom rollers against the force of a spring.

11. An arrangement according to claim 10, wherein the signal triggers one of an optical display and an acoustic report.

12. An arrangement according to claim 11, wherein the signal triggers a control mechanism for the stopping of at least a portion of the spinning machine.

13. An arrangement according to claim 4, wherein the contact elements are arranged so that they are detached from one another by the moving-away of a sensing element.

14. An arrangement according to claim 1, wherein the sensing elements are provided with contact surfaces which are situated opposite the circumference of the delivery bottom rollers at a distance and are moved away from them while overcoming a spring force.

15. An arrangement according to claim 1 wherein the signal triggers one of an optical display and an acoustic report.

16. An arrangement according to claim 1, wherein the signal triggers a control mechanism for the stopping of at least a portion of the spinning machine.

17. A spinning machine assembly including a lap monitoring arrangement for monitoring the lap formation on delivery rollers of drafting units of a spinning machine, and a drafting unit electric drive circuit which supplies electric power to control driving of a plurality of said drafting units of the spinning machine, said lap monitoring arrangement comprising:

sensing elements assigned to respective delivery rollers and being movable away from the delivery rollers when fibers accumulate on the delivery rollers, and a common electric circuit for generating a signal in response to the sensing elements, wherein groups of the sensing elements are connected to the common electric circuit, which common electric circuit is interrupted by the moving away of any one of said sensing elements to thereby interrupt the drafting unit electric drive circuit to stop the drive of said plurality of said drafting units.

18. An assembly according to claim 17, wherein the sensing elements of one side of the spinning machine form a group which has a common electric circuit, whereby all drafting units of one side of the spinning machine are stopped when an unacceptable accumulation of fibers occurs at any of the drafting units.

19. An assembly according to claim 17, wherein all sensing elements of a spinning machine form a group which has a common electric circuit, whereby all drafting units of the spinning machine are stopped when an unacceptable accumulation of fibers occurs at any of the drafting units.

* * * * *